United States Patent [19]

Agelatos et al.

[11] Patent Number: 4,944,045

[45] Date of Patent: Jul. 31, 1990

[54] CONDITION-SPECIFIC TOILET VENTILATION SYSTEM

[76] Inventors: Dionisios Agelatos; Sortirios Agelatos, both of 3883 Franklin Ave., Seaford, N.Y. 11783

[21] Appl. No.: 447,546

[22] Filed: Dec. 7, 1989

[51] Int. Cl.[5] ..... E03D 13/00; E03D 9/04; A47K 13/00

[52] U.S. Cl. ..... 4/213; 4/217; 4/347; 4/472

[58] Field of Search ..... 4/213, 217, 209, 211, 4/218, 219, 347, 306, 114.1, 472, 477, 482, 220, 221; 98/42.04

[56] References Cited

U.S. PATENT DOCUMENTS

| | | | |
|---|---|---|---|
| 3,049,722 | 8/1962 | Boggs | 4/213 |
| 4,007,498 | 2/1977 | Pearson | 4/213 |

FOREIGN PATENT DOCUMENTS

| | | | |
|---|---|---|---|
| 2720739 | 11/1978 | Fed. Rep. of Germany | 98/42.04 |
| 2728466 | 1/1979 | Fed. Rep. of Germany | 98/42.04 |
| 2758299 | 7/1979 | Fed. Rep. of Germany | 98/42.04 |
| 184844 | 11/1982 | Japan | 98/42.04 |

*Primary Examiner*—Henry K. Artis
*Attorney, Agent, or Firm*—Terry M. Gernstein

[57] ABSTRACT

A ventilation system for removing odorous air from a toilet bowl includes a chemically sensitive electronic transducer that senses the presence of methane gas and controls a fan and motor unit according to such presence. When the amount of methane in the toilet bowl drops below a predetermined quantity, the fan and motor unit is stopped, and such unit is started only when methane is present in such predetermined quantity.

1 Claim, 3 Drawing Sheets

CONDITION-SPECIFIC TOILET VENTILATION SYSTEM

TECHNICAL FIELD OF THE INVENTION

The present invention relates to the general art of baths, closets and sinks, and to the particular field of water closets.

BACKGROUND OF THE INVENTION

Bathrooms are frequently prone to having noxious odors. The use of the conventional toilet lends itself to odors of feces and urine being circulated throughout the bathroom. This is true even though the conventional toilet has water therein into which liquid and solid wastes are deposited. If the bathroom does not have an adequate ventilating system, these odors remain in the room and are often distributed to adjacent rooms when the bathroom door is open.

Most of these odors originate in the bowl of the conventional water toilet or water closet into which liquid and solid wastes are deposited and are later flushed away by water stored in a water storage tank.

Therefore, the art contains several designs for systems and devices for removing such odors. For example, the art contains systems which includes a fan-driven exhaust system connected to the bowl of the toilet or to the seat of a toilet. The exhaust system draws odorous air from the toilet bowl when the toilet is in use. The odorous air may be passed through a conduit and exhausted from the building, or it may be passed through a filter or purifying assembly and recirculated.

While somewhat successful, these devices and systems all suffer certain drawbacks which inhibit the full commercial success thereof.

The principal drawback with these devices is associated with the starting and stopping thereof. The known exhaust systems are all activated and stopped by one of three methods, to wit: manual activation and de-activation, as by a manual switch that is operated before and after toilet use; timed operation which is initiated either manually or automatically upon the occurrence of an event such as lowering the toilet seat; or automatic activation and de-activation upon the occurrence of a physical event such as weight being applied to the toilet seat (for activating the system) or weight being removed from the toilet seat (for de-activation).

All of these system-control occurrences require some physical action which may be only vaguely related to the actual condition for which the system is to be used. Thus, each of these actions really only implies the existence of odorous air, not the actual presence of such air. Such implied control may cause activation prior to actual generation of such noxious odors and/or cause de-activation either long before such odors are dissipated, or long after such odors are no longer present. In any case, the system may be operating when it is not needed, or not operating when it is needed.

Not only can this be inefficient and potentially ineffective, it may also be Wasteful of energy and may create unnecessary noise. Since noise is a form of environmental pollution, such prior systems may, in effect, merely be substituting one form of environmental pollution for another in a manner that does not reduce the noise pollution to the minimum required to effectively remove the odorous air from the bathroom.

Accordingly, there is a need for a toilet ventilation system which is condition specific in its operation and which will automatically activate only when needed, and which will automatically de-activate when it is no longer needed.

OBJECTS OF THE INVENTION

It is the main object of the present invention is to provide a toilet ventilation system which is condition specific in its operation.

It is another object of the present invention is to provide a toilet ventilation system which is condition specific in its operation and which will automatically activate only when needed.

It is another object of the present invention is to provide a toilet ventilation system which is condition specific in its operation and which will automatically activate only when needed, and which will automatically de-activate when it is no longer needed.

SUMMARY OF THE INVENTION

These, and other, objects are achieved by a system which is condition specific to be activated only when the odorous gases are actually present in sufficient quantities to be noxious, and is de-activated at all other times.

This result is accomplished by recognizing that certain gases are present in the digestive tract of all mammals, and are expelled during an evacuation of such digestive tract, and then activating the exhaust system only When such gases are found to be present in predetermined quantities. It is these digestive tract gases which are the noxious gases to be removed.

Heretofore, prior removal systems were activated according to conditions which were only indirectly related to the presence of these digestive tract gases and thus were inefficient. The system of the present invention actually senses the presence of such digestive tract gases and is activated only when such gases are actually present in quantities sufficient to be termed noxious.

These gases have been found to include oxygen, nitrogen, hydrogen, carbon dioxide, methane, hydrogen sulfide, indol, skatol, ammonia, and other gases. However, gases such as oxygen, nitrogen, hydrogen and carbon dioxide are generally present in the atmosphere, and thus cannot be reliably used as the condition signalling the presence of digestive tract gases. However, gases such as methane are generally not present in the atmosphere in significant quantities. Therefore, the ventilation system of the present invention uses methane as the gas signalling the presence of digestive tract gases.

The condition specific toilet ventilation system of the present invention includes a chemically sensitive electronic transducer to sense the presence of methane. This transducer is connected into a control unit which activates a fan and motor unit when a predetermined quantity of methane is sensed. The control unit includes a Wheatstone bridge circuit which connects the fan and motor unit to a power source when the Bridge is unbalanced.

In this manner, the toilet ventilation system of the present invention is activated according to the presence of digestive tract gases only when such gases are present in quantities sufficient to be noxious and thus is condition specific in operation rather than inferential in operation.

BRIEF DESCRIPTION OF THE DRAWING FIGURES

DETAILED DESCRIPTION OF THE PREFERRED EMBODIMENT OF THE INVENTION

Figure 1:
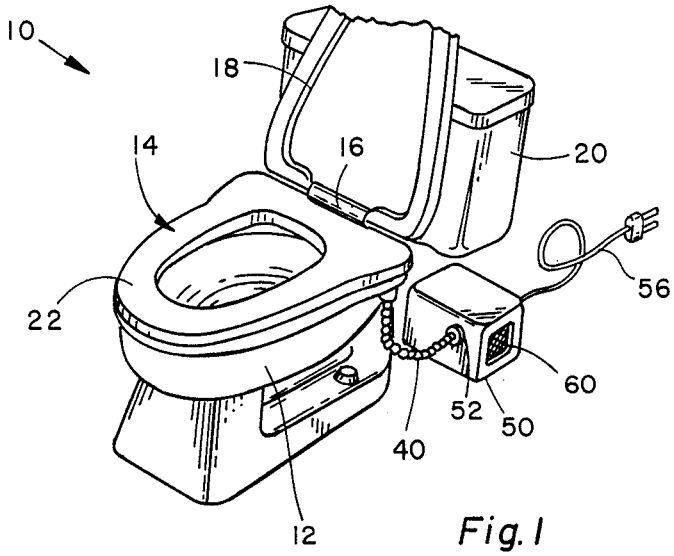
FIG. 1 is a perspective view of a toilet having a ventilation system embodying the present invention associated therewith.

As shown in FIG. 1, a conventional toilet 10 generally includes a bowl 12 having a seat 14 pivotally connected thereto by a hinge 16 and a cover 18 also pivotally connected to the bowl at the hinge 16. Water from a storage tank 20 is used to flush the toilet, and the toilet is connected to the usual sewage disposal system.

The seat 14 has a top surface 22 and a bottom surface 24 and is lowered or raised as necessary. Stops, such as stop 25 are positioned at various locations on the seat to abut the bowl upper edge and rest the seat on that upper edge.

Figure 2:
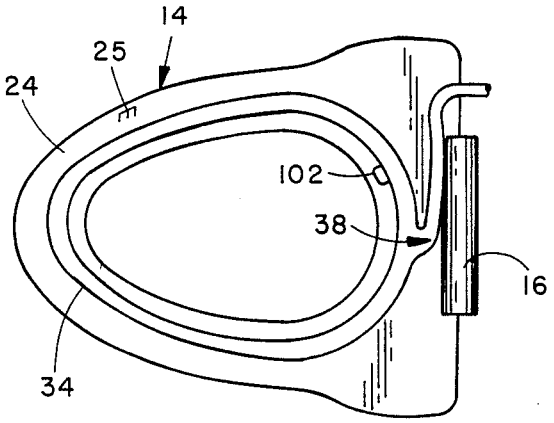
FIG. 2 is a bottom view of a toilet seat having an inlet unit of the ventilation system mounted thereon.
Figure 3:
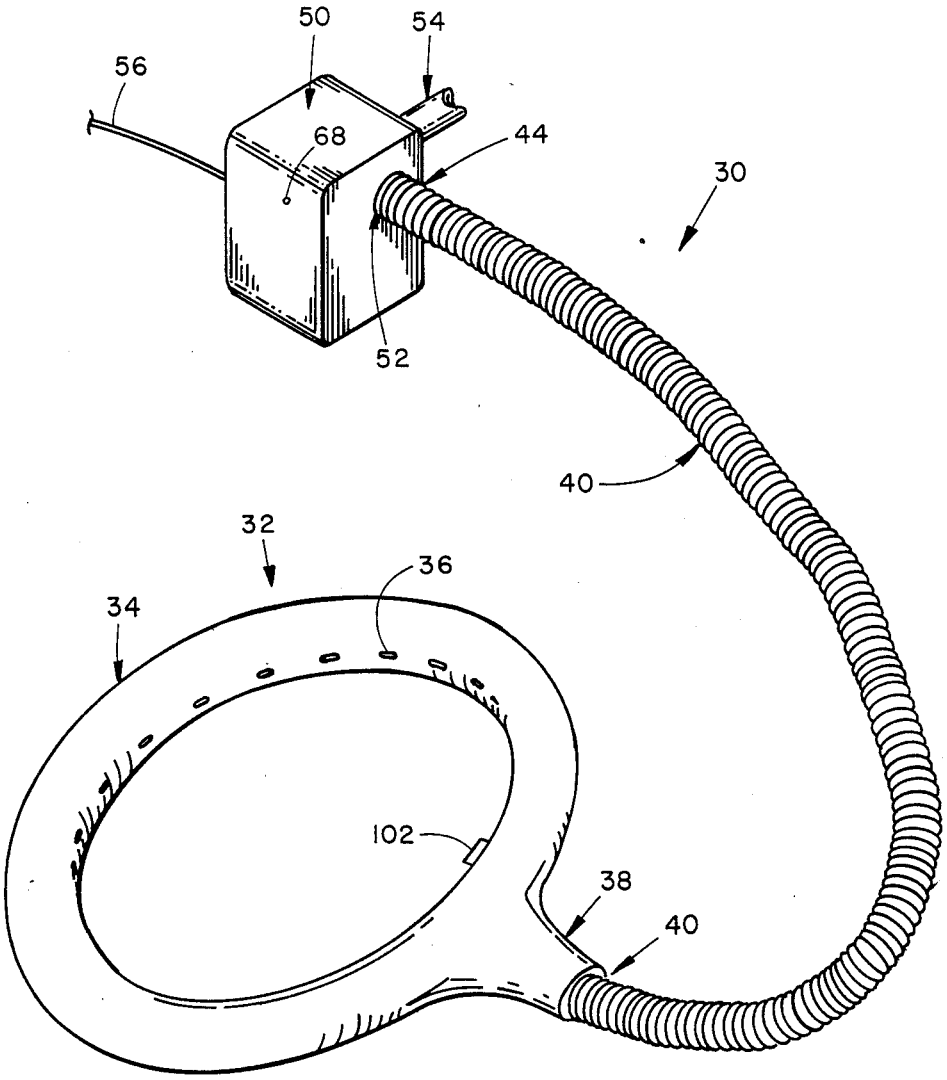
FIG. 3 is a perspective view of the ventilation system of the present invention.

The toilet 10 includes a ventilation system 30 of the present invention, and that ventilation system is best shown in FIG. 3. The ventilation system 30 includes an inlet unit 32 which is mounted on the bottom surface 24 of the toilet seat and includes a flexible, annular hollow housing 34 which has a multiplicity of inlet openings, such as inlet opening 36, defined therethrough. The housing is flexible so it can be shaped to match the shape of the toilet seat, and is mounted thereon in a groove defined in the seat or is simply affixed as by gluing to that seat bottom surface. The inlet openings are located to open inwardly of the toilet bowl, and a coupling element 38 is mounted on the housing in a position to be located adjacent to the hinge 16 at the rear of the bowl and seat, as indicated in FIG. 2.

A flexible hose 40 is fluidically attached at an inlet end 42 thereof to the coupling 38 and extends away from the seat as indicated in FIG. 2. The hose is sized to fit beneath the seat even when the seat is in the down position shown in FIG. 1. To ensure that the hose is not kinked When in such position, the seat bottom surface can be grooved so the inlet unit and hose fit into the seat as indicated in FIG. 1.

The hose 40 includes an outlet end 44 which is fluidically coupled to a fan and motor unit 50. The fan and motor unit can be any unit that is suitable for use in such an environment, and those skilled in the art of fans and motors will understand what type of unit will be necessary.

The flexible hose outlet end 44 is fluidically connected to an inlet 52 of the fan and motor unit, and fluid transferred to the fan and motor unit is exhausted from an outlet 54 as indicated by arrow 56. This fluid is sent to an exhaust system normal to bathroom ventilation systems. The fan and motor unit 50 establishes a pressure gradient in the system 30 from the inlet unit 32 towards the fan and motor outlet 54. The fan and motor unit is connected to a power source, such as utility power, by a cord 56.

Thus, fluid, such as odorous gases from the toilet bowl, is drawn into the system 30 via the inlet opening holes in the inlet unit, pass through the coupling 38 and into the flexible hose, and then pass through the fan and motor unit 50 to the exhaust system via the fan and motor unit outlet 54. The fan and motor unit can include a filter system so that the fluid can be recirculated back into the room if suitable. The filter can include activated charcoal or the like. This embodiment is indicated in FIG. 1 wherein a filter screen 60 is shown.

Figure 4:
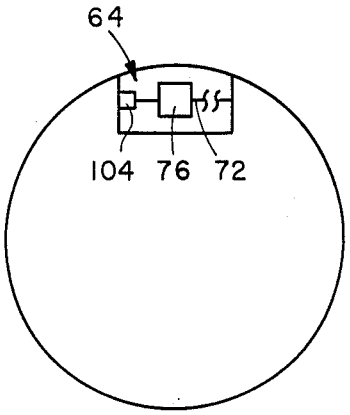
FIG. 4 illustrates a portion of the control unit of the present invention in place in a flexible hose element of the ventilation system.

A control unit 64 is mounted in the flexible hose as indicated in FIG. 4, and controls operation of the fan and motor unit according to the presence of methane gas in the toilet bowl. When there is a predetermined quantity of methane gas present in the toilet bowl, the control unit 64 activates the fan and motor unit; whereas, if the level of methane gas in the toilet bowl is below such predetermined level, the fan and motor unit is either de-activated or is not activated depending on the state of such fan and motor control unit prior to the level of methane gas dropping below the predetermined level. Thus, if the fan and motor unit is operating when the methane gas level drops below the predetermined level, the control unit de-activates that fan and motor unit. If, on the other hand, the fan and motor unit is not operating, it will not be activated until the level of methane gas in the toilet bowl reaches the predetermined level. The predetermined level can be set by a control knob 68 to any level suitable to the user since one user may consider a certain level of digestive gases present in the room noxious; whereas, another user may not consider such level as being noxious.

Figure 5:
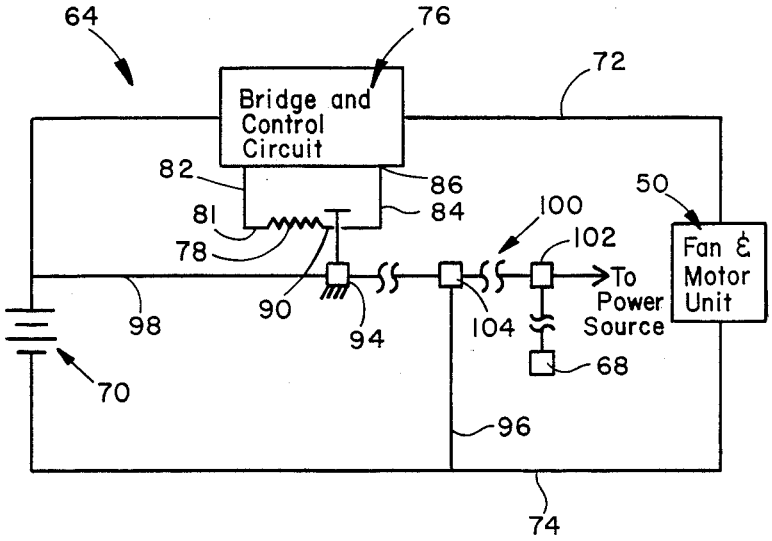
FIG. 5 is a circuit diagram illustrating the circuit used to control operation of the fan and motor unit of the ventilation system.

The control unit is best illustrated in FIG. 5 as connecting the power source 70 to the fan and motor unit 50 via line conductors, such as line conductor 72 and 74. The control unit includes a Wheatstone bridge circuit 76 serially interposed in the line conductor 72 between the power source and the fan and motor unit. The control system and Wheatstone bridge are set up so that circuit between the power source and the fan and motor unit is completed only When the Wheatstone bridge is in an unbalanced condition, and the circuit between the power source and the fan and motor unit is broken when the Wheatstone bridge circuit is in a balanced condition whereby the fan and motor unit will be activated only when the Wheatstone bridge circuit is unbalanced.

The balance of the Wheatstone bridge circuit is controlled by a resistor 78 that will unbalance the Wheatstone bridge when it is connected into the bridge circuit. The resistor is connected to a switch unit 80 for connection into the Bridge circuit to unbalance that circuit when a predetermined quantity of methane gas is present in the toilet bowl and for disconnection from that bridge circuit to permit that circuit to rebalance when less than that predetermined quantity of methane gas is present in the toilet bowl.

The switch unit 80 includes a first line conductor 82 connecting one side 81 of the resistor 78 to the Wheatstone bridge circuit 76, and a second, line conductor 84 connected at one end 86 to the bridge circuit and having a second end 88 spaced from a second side 90 of the resistor.

The switch unit 80 also includes an electrically conductive element 92 which is movable from a first position contacting both resistor second side 90 and line conductor second end 88 to electrically connect the resistor to the bridge circuit via the line conductors 82 and 84, to a second position spaced from the resistor second side 90 and from the line conductor second end 88 to remove the resistor from connection to the bridge circuit. The electrically conductive element second position is shown in FIG. 5. When the switch unit electrically conductive element 92 is in the first position, the Wheatstone bridge circuit 76 is unbalanced, and hence power is supplied to the fan and motor unit.

The electrically conductive element 92 is moved between the first and second positions by a solenoid 94 which is set up to move the element 92 into the contacting first position when that solenoid is activated, and to move the element 92 into the FIG. 5 second non-contacting position when the solenoid is de-activated.

The solenoid 94 is activated when it is connected to the power source via line conductors 96 and 98 and a solenoid activating unit 100 that connects the solenoid to the power source 70 when a predetermined quantity of methane gas is present in the toilet bowl.

The solenoid activating unit 100 includes a chemically sensitive electronic transducer 102 mounted on the housing to be located inside of the toilet bowl near the rear of that bowl where methane gas is most likely to be located. The chemically sensitive electronic transducer 102 is connected to a source of power, such as via the cord 56 to be continuously active in the sensing configuration, and generates a signal when sensing the presence of methane gas, and can be set to generate that signal only when a predetermined amount of methane gas is sensed. Thus, no signal will be generated by the chemically sensitive electronic transducer 102 until the predetermined amount of methane gas is present, the signal will be continuously generated while the level of methane gas is above the predetermined level, and any signal that is being generated will be stopped as soon as the level of methane gas in the toilet bowl drops below that predetermined level. The sensitivity of the transducer is adjusted using the control knob 68.

Chemically sensitive electronic devices are discussed in the literature, such as beginning at page 527 of "Handbook of Modern Electronics and Electrical Engineering", edited by Charles Belove and published by Wiley-Interscience in 1986, the disclosure of which is incorporated herein by reference. Accordingly, those skilled in the art of electronic transducers will understand exactly what type of element will be necessary to carry out the functions and operations set forth in this disclosure. Thus, the exact nature of the chemically sensitive electronic transducer will not be presented herein.

The transducer 102 is connected to a switch 104 which receives signals from that transducer, and completes the circuit between line conductors 96 and 98 to connect the solenoid 94 to the power source 70. Connection of the solenoid 94 to the power source 70 activates that solenoid to move the electrically conductive element into the first position electrically coupling the resistor second side 90 to the line conductor second side 88 and placing the resistor 78 into the Wheatstone bridge circuit to activate the fan and motor unit. As soon as the level of methane gas drops below the predetermined level, the transducer 102 stops sending a signal to the switch 104, and that switch interrupts the circuit to the solenoid, and the solenoid is de-activated. De-activation of the solenoid moves the electrically conductive element 92 back into the FIG. 5 second position and removes the resistor 78 from the Wheatstone bridge circuit thereby causing that circuit to be balanced. Such a balance Wheatstone bridge circuit interrupts the circuit between the power source and the fan and motor unit, and that fan and motor unit stops operation. Suitable diodes and other circuit elements are included in the circuit to ensure proper operation as will occur to those skilled in the electronics art.

It is understood that while certain forms of the present invention have been illustrated and described herein, it is not to be limited to the specific forms or arrangements of parts described and shown.

We claim:

1. A condition-specific toilet ventilation system comprising:

(A) an inlet unit mounted on a bottom surface of a toilet seat, said inlet unit including
  (1) a flexible annular hollow housing having a multiplicity of inlet openings defined therethrough, and
  (2) a coupling element mounted on said housing;

(B) a flexible hose fluidically connected at an inlet end thereof to said inlet unit coupling element and having an outlet end;

(C) a fan and motor unit which includes
  (1) an inlet fluidically coupled to said flexible hose outlet end, and
  (2) an outlet;

(D) a power source;

(E) a control unit mounted in said flexible hose for electrically connecting said fan and motor unit to said power source and including
  (1) a Wheatstone bridge circuit which connects said fan and motor unit to said power source when said Wheatstone bridge circuit is unbalanced and which disconnects said fan and motor unit from said power source when said Wheatstone bridge circuit is balanced,
  (2) a resistor which will unbalance said Wheatstone bridge circuit when it is connected into said Wheatstone bridge circuit,
  (3) a switch unit for connecting said resistor into said Wheatstone bridge circuit when a predetermined quantity of methane gas is present in a bowl of a toilet and for disconnecting said resistor from said Wheatstone bridge circuit when less than said predetermined quantity of methane gas is present in the bowl, said switch unit including
    (a) a first line conductor connecting one side of said resistor to said Wheatstone bridge circuit,
    (b) a second line conductor connected at one end thereof to said Wheatstone bridge circuit and having a second end spaced from a second side of said resistor,
    (c) an electrically conductive element which is movable between a first position electrically connecting said second line conductor second end to said resistor second side to connect said resistor into said Wheatstone bridge circuit and a second position spaced from said second line conductor second end and spaced from said resistor second side to disconnect said resistor from said Wheatstone bridge circuit,
    (d) a solenoid connected to said electrically conductive element to move said electrically conductive element into said first position to connect said resistor to said Wheatstone bridge circuit when activated, and to move said electrically conductive element into said second position when deactivated to disconnect said resistor from said Wheatstone bridge circuit when de-activated, (e) solenoid activating unit for connecting said solenoid to said power source to activate said solenoid when said predetermined quantity of methane gas is present in the bowl of the toilet, said solenoid activating unit including (i) a chemically sensitive electronic transducer mounted on said inlet unit hollow housing in the bowl of the toilet near a rear section of the toilet, said chemically sensitive electronic transducer generating a signal when sensing menthane gas in said predetermined quantity and failing to generate a signal when sensing methane gas in quantities less than said predetermined quantity, (ii) a control element connected to said chemically sensitive electronic transducer to adjust the sensitivity of said chemically sensitive electronic transducer, and (iii) a switch connected to said chemically sensitive electronic transducer to receive said signal therefrom and connected to said solenoid to connect said solenoid to said power source to activate said solenoid when said switch is receiving said signal from said chemically sensitive electronic transducer and disconnecting said solenoid from said power source to de-activate said solenoid when failing to receive said signal from said chemically sensitive electronic transducer.

* * * * *